US005082329A

United States Patent [19]

Mars

[11] Patent Number: 5,082,329

[45] Date of Patent: Jan. 21, 1992

[54] KNOCK-DOWN CHAIR

[76] Inventor: Suzanne P. Mars, 23649 Duffield Rd., Shaker Hts., Ohio 44122

[21] Appl. No.: 510,143

[22] Filed: Apr. 17, 1990

[51] Int. Cl.[5] ..... A47C 7/00

[52] U.S. Cl. ..... 297/442; 297/416; 297/418

[58] Field of Search ..... 297/442, 440, 460, 411, 297/418, 416, 449; 108/111, 119; 211/186–188

[56] References Cited

U.S. PATENT DOCUMENTS

| | | | |
|---|---|---|---|
| 1,769,722 | 7/1930 | Sutton | 297/418 |
| 2,595,002 | 4/1952 | Schneider | 211/186 |
| 2,776,700 | 1/1957 | Potter et al. | 297/442 |
| 3,471,199 | 10/1969 | Kuhlmann | 297/418 |
| 3,987,737 | 10/1976 | Smith | 108/111 |
| 4,036,150 | 7/1977 | Algier | 297/188 |
| 4,082,356 | 4/1978 | Johnson | 297/442 |
| 4,140,065 | 2/1979 | Chacon | 297/440 |
| 4,191,113 | 3/1980 | Hogberg | 297/440 |

*Primary Examiner*—Kenneth J. Dorner

*Assistant Examiner*—James M. Gardner

*Attorney, Agent, or Firm*—Weston Hurd Fallon Paisley & Howley

[57] ABSTRACT

A knock-down chair adapted to be set on a floor is provided. The knock-down chair includes a plurality of upright members and a seat member having a peripheral edge. The seat member defines a plurality of slots for receiving portions of the upright support members, which slots are preferably disposed proximate to the peripheral edge of the seat member. Ledges are configured on each of the upright support members for supporting the seat member and for spacing a seat member from the floor. Upon positioning the upright support members in a predetermined position and bringing the seat member into contact with the ledges by sliding portions of the upright support members through the slots of the seat member, the seat member is selectively maintained in a substantially horizontal position thereby allowing a person to comfortably and securely be supported by the seat member when sitting in the chair.

11 Claims, 4 Drawing Sheets

KNOCK-DOWN CHAIR

BACKGROUND OF THE INVENTION

1. Field of the Invention

The present invention relates to an article of furniture, and more specifically to a knock-down chair having a simple, yet exceedingly stable construction.

2. Description of the Prior Art

It is well accepted that young people generally wear down furniture quickly, and that they do not always appreciate the comfort afforded by more expensive furniture articles. Moreover, it is not always cost effective to provide children or young adults with more permanent furniture. Consequently, knock-down chairs find frequent use with children and young adults.

The typical knock-down chair, which is constructed from a plurality of parts can be particularly deficient. First, they can be difficult to construct due to the many parts employed, which parts are quite often poorly coded. Second, the chair can be constructed from non-symmetrical parts which may be difficult, or at least expensive, to manufacture. Finally, and probably most significantly, the typical knock-down chair, when fully constructed, is poorly arranged and highly unstable.

There is clearly a need for a knock-down chair that meets certain minimum criteria. First, the knock-down chair should be characterized by an economical yet simple design having relatively few parts, which parts possess as much symmetry as possible. Second, the assembly of the knock-down chair should be so simple that even a child can assemble it. Finally, the knock-down chair should be functional, stable and relatively comfortable.

It is believed that known knock-down chairs generally lack one or more of the above-mentioned criteria. Hence there is a great need for a more ideal knock-down chair such as the one described below.

SUMMARY OF THE INVENTION

A knock-down chair adapted to set on a floor is provided. The chair includes a plurality of upright supports and a seat member having a peripheral edge. The seat member defines slots, which are disposed proximate to the peripheral edge of the seat member, for receiving the upright support members. Support means are configured on the upright support members for supporting the seat member and for spacing the same from the floor when the chair is being used. Upon positioning the upright support members in a predetermined position, the seat member is disposed into an abutting relationship with the support means by sliding the slots downward relative to the upright support members. When the seat member is resting on the support means, the seat member is maintained in a substantially horizontal position such that a person can be comfortably and securely supported by the seat member.

In a preferred embodiment the upright support members define first and second edges while the support means include a first ledge and a second ledge, which first ledge and second ledge are disposed proximate to the first side edge and the second side edge, respectively. Moreover, a shelf member and back support means are operatively connected to lower and upper portions of the upright support members, respectively, to further stabilize the chair. Finally, the chair is color coded to facilitate construction thereof. That is, substantial sections of two portions of the chair are characterized by different colors so that by following a simple set of instructions and noting the colors, even a child can construct the chair.

In the preferred form of assembly, the upright support members are arranged into a predetermined position and at least two of the upright support members are braced together. The shelf member and then the seat member are slid down along the upright support members until they are abuttingly secured along ledges configured into the upright support members. The back support means is operatively mounted to upper end portions of the upright support members.

Numerous advantages of the present invention will be appreciated by those skilled in the art.

One advantage of the present invention is that it is simply, yet durably constructed. The components are easily fitted together to provide an efficient and stable structure. In one example, the strength and stability of the construction are enhanced by the use of a tripod configuration which is known to provide a high level of stability. The fastening arrangement of the present chair facilitates both secure assembly and easy disassembly.

Another advantage of the present invention is that it provides a color coding scheme that facilitates construction. In particular, by using a dual color scheme, several objectives of the present invention are realized. For example, the chair is easier to construct because excessive amounts of time are not spent in determining the relationship of the components. Moreover, the color coordination serves an important educational objective for children. That is, by assembling the color coded chair, a child learns to recognize patterns, cohesively assemble parts as a whole and thus gain practice in eye-hand coordination.

Yet another advantage of the present invention is that it is easy to manufacture and economical. More specifically, there are relatively few parts to produce and their production schemes are relatively uncomplicated. It follows that the parts can be manufactured quickly and in large numbers which leads to efficiencies of scale. Moreover, since there are relatively few parts and they are color coordinated, it is easy to assemble packages for sale.

Yet another advantage of the present invention is that it is exceedingly practical and cost effective. In particular since the chair can be readily broken down into basic components it is quite portable. Moreover the chair is easy to store when its use is not desired. Finally, due to the efficient design of the chair it can be used by young adults as well as children.

These and other features, advantages and objects of the present invention will be further understood and appreciated by those skilled in the art by reference to the following written specification, claims and appended drawings.

DESCRIPTION OF THE PREFERRED EMBODIMENT

It is to be understood that the invention described below may assume various alternative orientations and step sequences except where expressly specified to the contrary. It is also to be understood that the specific devices and processes illustrated in the attached drawings, and described in the following specification, are simply exemplary embodiments of the inventive concepts defined in the appended claims. Hence, specific dimensions, and other physical characteristics related to the embodiments disclosed herein are not to be considered as limiting, unless the claims by their language expressly state otherwise.

Figure 1:
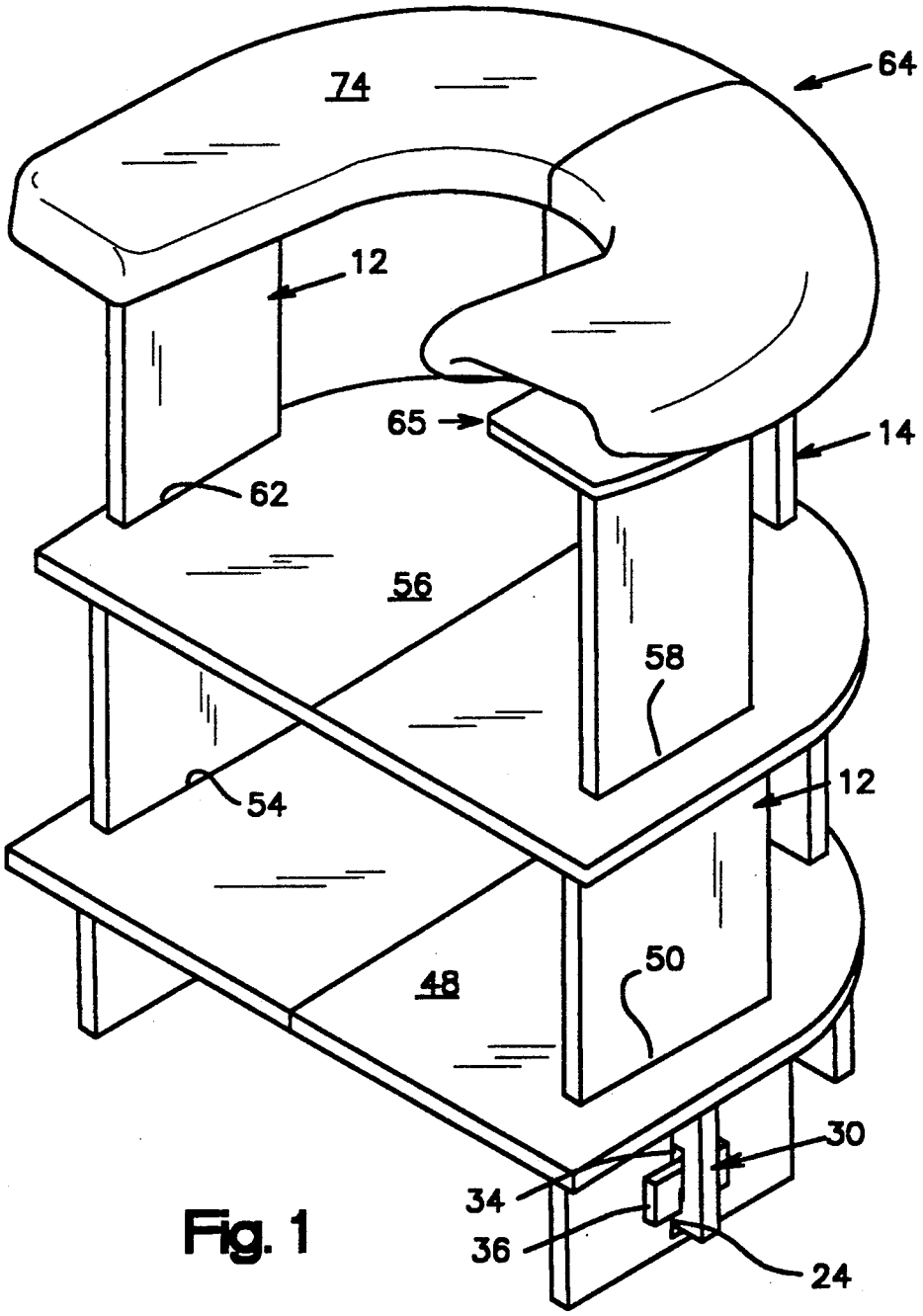
FIG. 1 is a perspective view of the knock-down chair embodying the present invention and the view includes a back rest having a portion raised to facilitate viewing of a top support member.

Referring to FIG. 1, a knock-down chair is indicated by the numeral 10. The knock-down chair 10 includes side supports 12 and a back support 14. Each of the side supports 12 is identical in construction, and therefore will be indicated with similar numerals. Moreover, only one of the supports 12 will be described in detail, with the understanding that the discussion for one of side supports 12 serves to describe both of the side supports 12.

Figure 2:
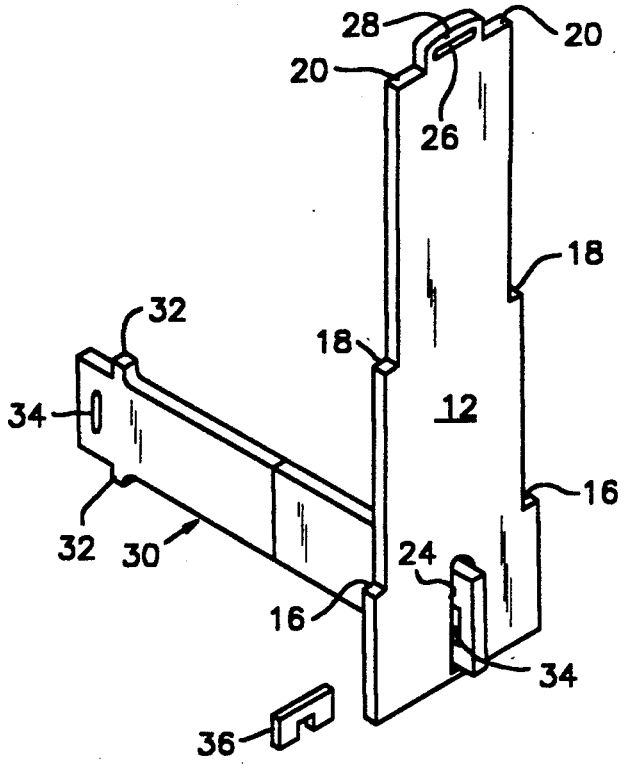
FIG. 2 is a partially exploded, perspective view of an upright support member connected to a brace.
Figure 3:
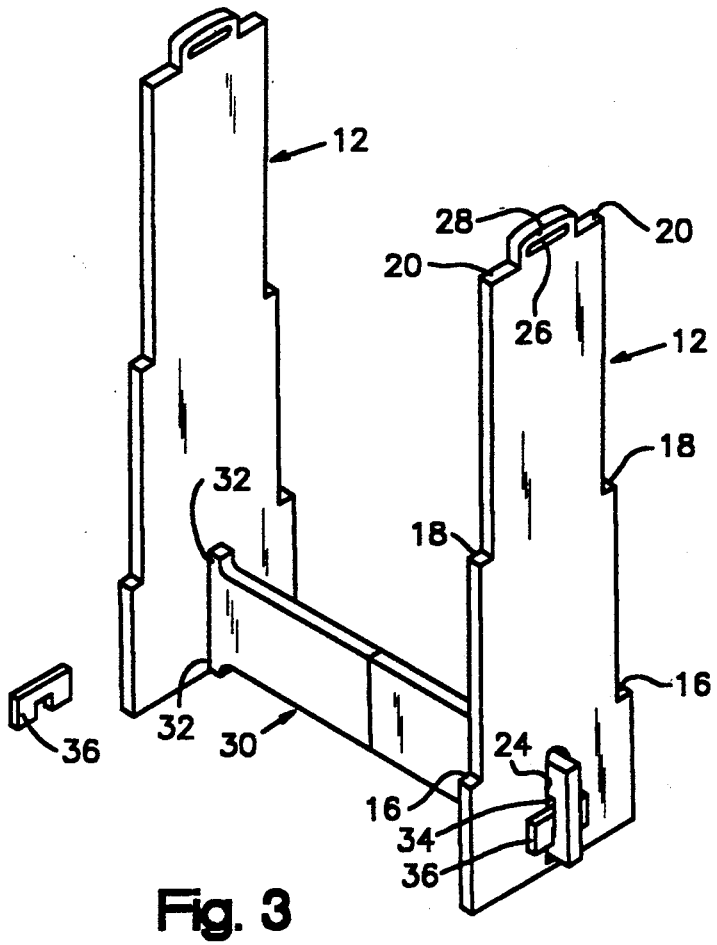
FIG. 3 is a partially exploded, perspective view similar to that of FIG. 2 with a second upright support member connected to the brace.

In the preferred embodiment, the side support 12 is configured with a pair of bottom ledges 16 (FIG. 2), a pair of intermediate ledges 18, and a pair of upper ledges 20. As best illustrated in FIG. 2, the side support 12 defines a bottom slot 24, as well as a top slot 26. Additionally, a curved projection 28, which is integrally formed with side support 12, is disposed along an upper portion thereof.

Lower portions of side supports 12 are interconnected by a brace 30, which brace 30 includes integral projections 32 which are formed along each side of brace 30 and disposed near end portions of brace 30. When the end portion of brace 30 is inserted through bottom slot 24, the projections 32 abut a surface of the side support 12. A slot 34 is also disposed near the end of brace 30 and fastening means 36 are employed to secure brace 30 to side support 12.

Figure 4:
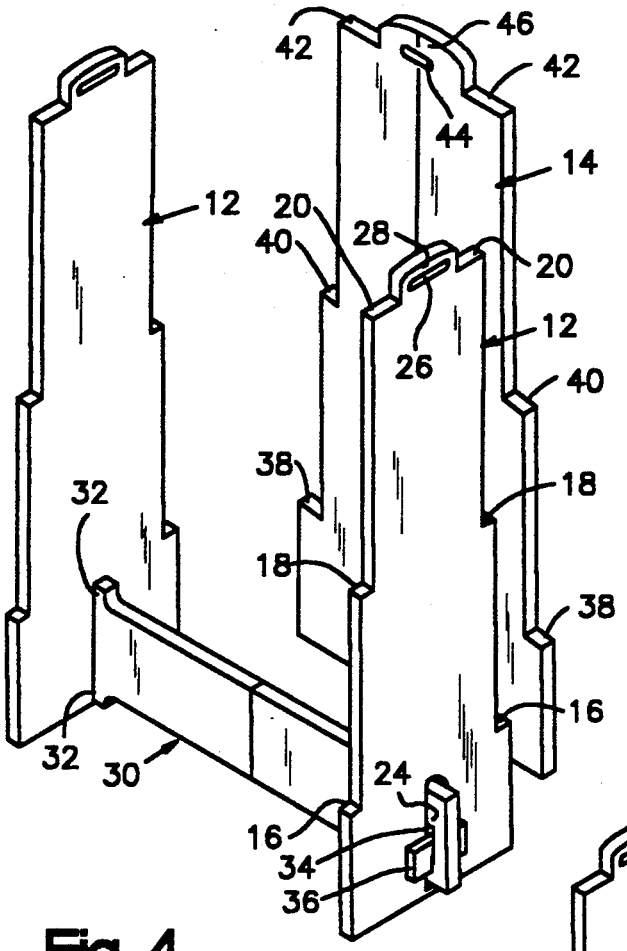
FIG. 4 is a perspective view similar to that of FIG. 3 with an additional upright support member.

Referring to FIG. 4, the back support 14 is configured with a set of bottom ledges 38, a pair of intermediate ledges 40, and a pair of upper ledges 42. When side supports and back support 14 are set on a floor as in FIG. 4, the heights of ledges 16, 18 and 20 are the same as the heights of ledges 38, 40 and 42, respectively. The advantage of this design feature will become evident from the discussion below. A top slot 44 is defined near a top portion of the back support 14 and a curved projection 46 is formed integrally with and extends from the top portion of back support 14.

Figure 5:
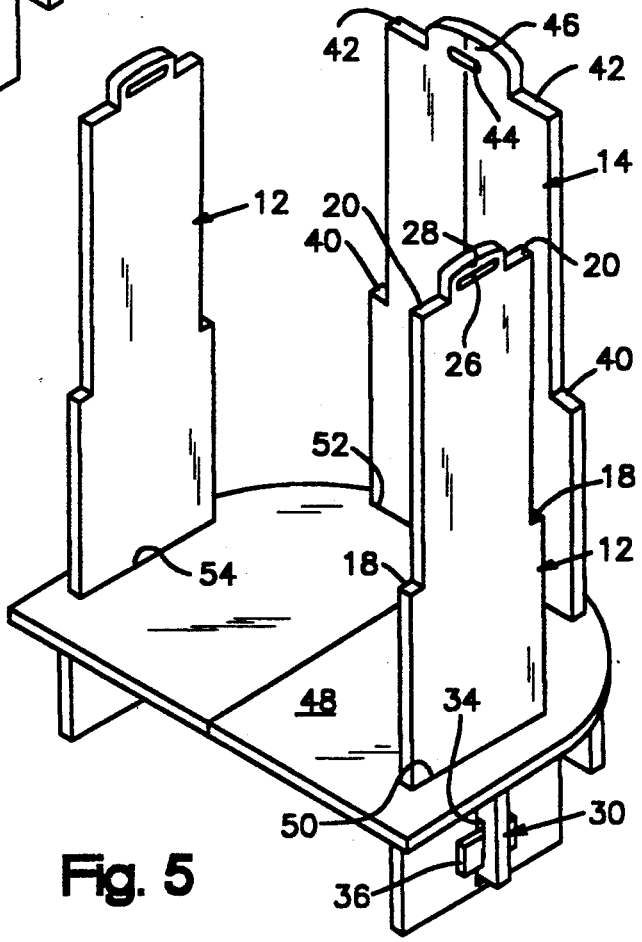
FIG. 5 is a perspective view similar to that of FIG. 4 with a shelf member being supported by ledge portions of the upright support members.

Referring to FIG. 5, a first platform or shelf member 48 is provided with slots 50, 52 and 54, which are preferably located along a periphery of the platform 48. As will be explained in further detail below, the platform 48 advantageously serves the purposes of providing a shelf and means for stabilizing a lower portion of the knock-down chair 10.

Figure 6:
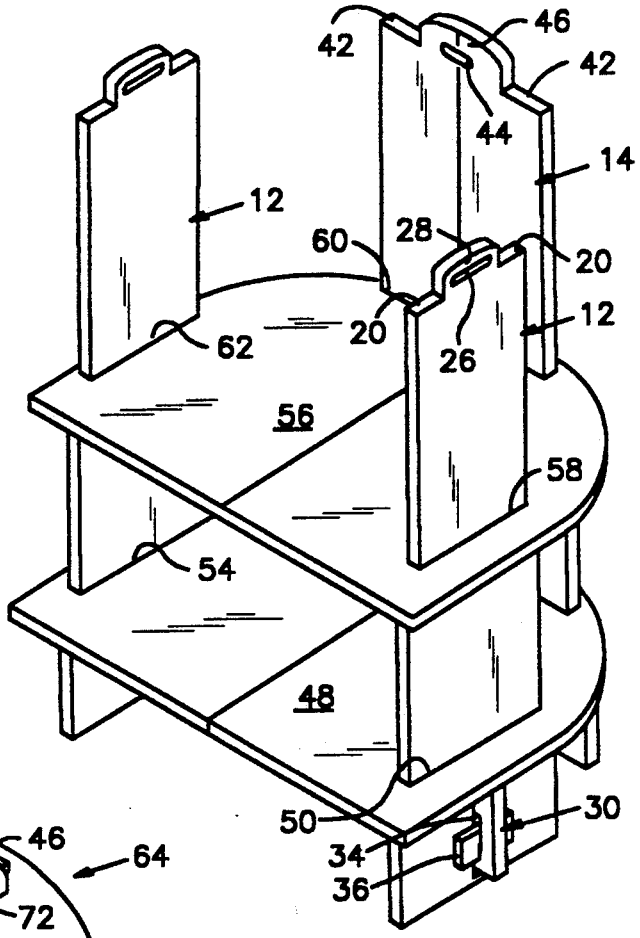
FIG. 6 is a view similar to that of FIG. 5 with a seat member being supported by ledge portions of the upright support members.

Referring to FIG. 6, a second platform or seat member 56 is provided with slots 58, 60 and 62, which are preferably located along a periphery of the platform 56. As can be recognized, the platform 56 is particularly useful as a seat member for the chair 10, as well as a means for stabilizing a mid-section of the chair 10.

Figure 7:
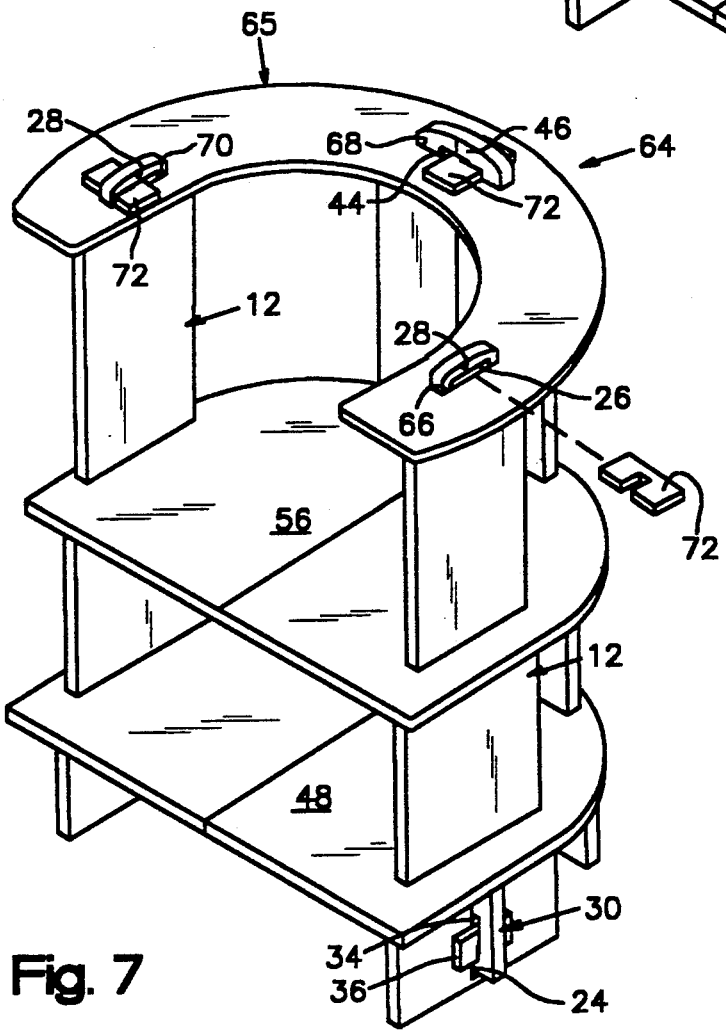
FIG. 7 is a view similar to that of FIG. 6 with a top support section supported by and detachably fastened to top end portions of the upright support members.

Referring to FIG. 7, a top assembly is indicated by the numeral 64. The top assembly 64 includes a substantially "U" shaped support section 65 having slots 66, 68 and 70 spaced therealong. As further illustrated by FIG. 7, fastening means 72, which are employed to secure projections 28 and 46, to support section 65, are provided. In the preferred embodiment, a back rest 74 (FIG. 1) is received by the projections 28, 46 and is supported by support section 65. The backrest 74 includes conventional female receiving means, such as notches (not shown), on its underside to receive the projections 28, 46.

Referring to FIGS. 1–7, the knock-down chair 10 is preferably assembled by appropriately spacing side supports 12 (FIG. 2) from one another and inserting each end of brace 30 into one of the bottom slots 24 of the side supports 12. The side supports 12 are interconnected with brace 30 by securing fastening means 36, which, in one example, are pegs, to the ends of brace 30. In the preferred embodiment, the fastening means 36 are retained along the ends of brace 30 by an interference fit, so that the fastening means are held in place by friction.

Upon appropriately positioning the back support 14 laterally of the side supports 12 (FIG. 3), the first platform 48 (FIG. 4) is fitted over the side supports 12 and the back support 14 using the slots 50, 52, and 54. The first platform 48 is slid downward along the supports 12, 14 until it abuts the bottom ledges 16, 38. As can now be appreciated, use of platform 48 serves not only to space supports 12 and 14 into an advantageous tripod configuration, but to maintain them in an upright position. Moreover, the platform 48 serves as a shelf upon which articles can be placed.

After positioning supports 12, 14 with platform 48, the second platform 56 (FIG. 6) is fitted over the side supports 12 and back support 14, using slots 58, 60 and 62. The second platform 56 is slid downward relative to the supports 12 and 14 until it abuts the intermediate ledges 20 and 40. As can now be appreciated, the second platform 56 serves as a second means for stabilizing the chair. Additionally, the height of intermediate ledges 20 and 40 is appropriately spaced, relative to a floor upon which the chair 10 sets, so that the chair 10 can be used by preadolescents and adolescents. Finally, since slots 58, 60 and 62 are disposed along the periphery of platform 56, a substantial portion of platform 56 is useable for seating children of many different sizes.

Referring to FIGS. 1 and 7, the support section 65 is fitted over the side supports 12 and tack support 14 using slots 66, 68 and 70, so that support section 65 abuts top ledges 22 and 44. The support section 65 is selectively interconnected with the supports 12, 14 by way of fastening means 72, which are preferably pegs, that can be secured to projections 28 and 46 by an interference fit. To install the back rest 74, the notches of the back rest 74 (not shown) are aligned with the projections 28, 46, and the back rest 74 is pressed downward until a bottom rim thereof abuts support section 65. As can be appreciated, the back rest 74 is advantageously positioned at a predetermined height by the support sections 12 and 14, and the notches can be frictionally fitted with the projections 28, 46 so that the back rest 74 is securely positioned on the supports 12 and 14.

It is of particular significance that portions of the chair 10 are color-coded to facilitate assembly thereof. More particularly, as indicated by dividing lines shown in FIGS. 1–7, most of the chair components, such as the side supports 12, the back support 14, the brace 30, the platforms 48, 56 and 65, as well as the back rest 74, are preferably painted or stained with one or two colors. Using a color-coding system allows even a child to quickly and correctly assemble the chairs by matching appropriate colors.

For example, referring to FIG. 1, it can be noted that the chair 10 is divided in half by the dividing lines. In the preferred embodiment, all of the components or parts on one half, except the fastening means 36, 72, are characterized by a first color and all of the components or parts on the other half, except the fastening means 36, 72, are characterized by another color. It will be understood that by matching the colors, the chair 10 can be quickly constructed as long as the user has a general understanding of the above-described methodology of construction.

A knock-down chair of exceedingly simple construction and which can be readily assembled has been described above. Due to the structure and design of the chair, it is both economical and easy to manufacture. While the chair can be used by people of many sizes, it is particularly appropriate for children since its design is both interesting and educational. The color-coding scheme insures that even children will be able to construct the chair with a minimal level of frustration. At the same time, in its broken-down state, the chair is portable and can be readily stored and/or moved from one place to another. It is to be understood that the invention described below may assume various alternative orientations and step sequences except where expressly specified to the contrary. It is also to be understood that the specific devices and processes illustrated in the attached drawings, and described in the following specification, are simply exemplary embodiments of the inventive concepts defined in the appended claims. Hence, specific dimensions, and other physical characteristics related to the embodiments disclosed herein are not to be considered as limiting, unless the claims by their language expressly state otherwise.

In the preferred embodiment, the chair is constructed of either wood or masonite. As will be understood by those skilled in the art, injection-molded plastic material could be employed to serve as the components. In the best presently contemplated mode, the chair is approximately 22 inches high, 15 inches wide at the front of the chair and 11–12 inches deep near a bottom portion of the chair.

In the foregoing description, it will be readily appreciated by those skilled in the art that modifications may be made to the invention without departing from the concepts disclosed herein. Such modifications are to be considered as included in the following claims unless those claims, by their language, expressly state otherwise.

What is claimed is:

1. A knock-down chair adapted to be placed on a floor, comprising:

three upright support members, two of the support members being disposed at the sides of the chair and defining side supports, the third support member being disposed at the back of the chair and defining a back support;

a laterally extending brace interconnecting and spacing the side supports, the brace being disposed at a vertical elevation near the floor;

a seat member having a peripheral edge, the seat member including slots through which the side supports and the back support extend, the slots being disposed proximate the peripheral edge of the seat member;

first support means included as part of the support members for supporting the seat member and for spacing the seat member from the floor at a vertical elevation above the brace;

a generally U-shaped back rest, the back rest including slots through which the side supports and the back support extend; and second support means included as part of the support members for supporting the back rest and for spacing the back rest from the floor at a vertical elevation above the seat member, the back rest being disposed adjacent the upper end of the side supports and the back support.

2. The chair of claim 1, wherein the first support means includes laterally extending ledges upon which the seat member rests in use, and the second support means includes laterally extending ledges upon which the back rest rests in use.

3. The chair of claim 1, wherein the upright support members taper along their length from a wider portion adjacent the floor to a narrower portion adjacent the back rest.

4. The chair of claim 1, wherein end portions of the brace includes openings and the end portions of the brace extend through openings in the side supports, the chair further comprising pegs adapted to (a) extend through the openings in the end portions of the brace and (b) engage the side supports.

5. The chair of claim 1, wherein the upper portions of the side supports and the back support include openings and the upper portions of the side supports and the back support extend through the slots in the back rest, the chair further comprising pegs adapted to (a) extend through the openings in the upper portions of the side supports and the back support and (b) engage the back rest.

6. The chair of claim 1, further comprising:

a shelf member having a peripheral edge, the shelf member including slots through which the upright support members extend, the slots being disposed proximate the peripheral edge of the seat member; and third support means included as part of each of the upright support members for supporting the shelf member and for spacing the shelf member at a vertical elevation between the brace and the seat member.

7. The chair of claim 6, wherein the third support means includes laterally extending ledges upon which the shelf member rests in use.

8. The chair of claim 1, further comprising a cushion disposed atop the back rest, the cushion being connected to the back rest.

9. The chair of claim 1, wherein one of the side supports is provided in a first color, and the other side support is provided in a second color, and portions of the brace, seat member, and back rest adjacent their connection with the side supports are provided in colors matching those of the side supports.

10. A knock-down chair adapted to be placed on a floor, comprising:

three upright support members, two of the support members being disposed at the sides of the chair and defining side supports, the third support member being disposed at the back of the chair and defining a back support, the support members tapering along their length from a wider portion adjacent the floor to a narrower portion adjacent their upper ends;

a laterally extending brace interconnecting and spacing the side supports, the brace being disposed at a vertical elevation near the floor, the brace including end portions having openings, and the end portions of the brace extending through openings formed in the side supports;

pegs adapted to extend through the openings in the end portions of the brace and engage the side supports;

a seat member having a peripheral edge, the seat member including slots through which the side supports and the back support extend, the slots being disposed proximate the peripheral edge of the seat member;

first support means in the form of laterally extending ledges included as part of the support members for supporting the seat member and for spacing the seat member from the floor at a vertical elevation above the brace;

a generally U-shaped back rest, the back rest including slots through which the side supports and the back support extend;

second support means in the form of laterally extending ledges included as part of the support members for supporting the back rest and for spacing the back rest from the floor at a vertical elevation above the seat member, the back rest being disposed adjacent the upper end of the side supports and the back support;

openings formed in the upper portions of the side supports and the back support, the upper portions of the side supports and the back support extending through the slots in the back rest;

pegs adapted to extend through the openings in the upper portions of the side supports and the back support and engage the back rest;

a cushion disposed atop the back rest, the cushion being connected to the back rest;

a shelf member having a peripheral edge, the shelf member including slots through which the upright support members extend, the slots being disposed proximate the peripheral edge of the seat member; and third support means in the form of laterally extending ledges included as part of the upright support members for supporting the shelf member and for spacing the shelf member at a vertical elevation between the brace and the seat member.

11. The chair of claim 10, wherein one of the side supports is provided in a first color, and the other side support is provided in a second color, and portions of the brace, seat member, shelf member, and back rest adjacent their connection with the side supports are provided in colors matching those of the side supports.

* * * * *